US007614544B2

(12) United States Patent
Trenner et al.

(10) Patent No.: US 7,614,544 B2
(45) Date of Patent: Nov. 10, 2009

(54) INTERMEDIATE CASH BOX

(75) Inventors: Dietmar Trenner, Berlin (DE); Roland Griese, Berlin (DE)

(73) Assignee: Walter Hanke Mechanische Werkstatten GmbH & Co., KG, Berlin (DE)

( * ) Notice: Subject to any disclaimer, the term of this patent is extended or adjusted under 35 U.S.C. 154(b) by 0 days.

(21) Appl. No.: 11/910,707

(22) PCT Filed: Apr. 6, 2006

(86) PCT No.: PCT/EP2006/003746

§ 371 (c)(1),
(2), (4) Date: May 9, 2008

(87) PCT Pub. No.: WO2006/105997

PCT Pub. Date: Oct. 12, 2006

(65) Prior Publication Data

US 2008/0264756 A1 Oct. 30, 2008

(30) Foreign Application Priority Data

Apr. 7, 2005 (DE) ..... 10 2005 016 817

(51) Int. Cl.
*G07B 15/00* (2006.01)

(52) U.S. Cl. ..... 232/15; 232/16; 232/57; 194/346

(58) Field of Classification Search ..... 232/15, 232/16, 43.3, 55, 57, 57.5; 194/344, 346; 453/3; 206/0.81, 0.815
See application file for complete search history.

(56) References Cited

U.S. PATENT DOCUMENTS

| | | | | | |
|---|---|---|---|---|---|
| 3,030,008 | A | * | 4/1962 | Jensen | 232/57.5 |
| 4,630,624 | A | * | 12/1986 | Turner | 194/346 |
| 4,782,937 | A | * | 11/1988 | Chen et al. | 194/346 |
| 4,795,087 | A | | 1/1989 | Procak | |
| 4,841,563 | A | * | 6/1989 | Sano et al. | 379/150 |
| 4,959,580 | A | | 9/1990 | Vishnevsky et al. | |
| 5,373,929 | A | | 12/1994 | Chittleborough et al. | |
| 5,407,051 | A | * | 4/1995 | Wohlrab | 194/346 |
| 5,485,906 | A | | 1/1996 | Newton et al. | |
| 6,206,168 | B1 | | 3/2001 | Hendricks | |
| 6,349,811 | B1 | * | 2/2002 | Chung | 194/346 |

FOREIGN PATENT DOCUMENTS

| | | |
|---|---|---|
| CH | 673719 | 3/1990 |
| DE | 3731857 | 3/1989 |
| GB | 2070307 | 9/1981 |

* cited by examiner

*Primary Examiner*—William L. Miller
(74) *Attorney, Agent, or Firm*—Fay Kaplun & Marcin, LLP

(57) ABSTRACT

An intermediate cash box includes a flap assembly that is pivotally mounted in a housing, said assembly forming a receptacle for coins in its resting position. When the flap assembly is pivoted in a controlled manner, this releases the coins into a return channel or a cash box. The flap assembly comprises two V-shaped flaps, each flap being assigned to a pivotally mounted gate lever with a slide-gate track that guides the displacement of the flap. A rotatably mounted displacement transfer element, which is driven by a drive, is in contact with the gate levers and transfers the displacement of the drive to one of the respective gate levers in order to pivot the latter.

14 Claims, 2 Drawing Sheets

INTERMEDIATE CASH BOX

PRIORITY CLAIM

This application claims the benefit of German Patent Application Serial No. DE 10 2005 016 817.5 filed on Apr. 7, 2005 and to PCT patent application Serial No. PCT/DE2006/003746 filed on Apr. 6, 2006. The specifications of these applications are expressly incorporated by reference into this application in their entirety.

BACKGROUND INFORMATION

The invention relates to an intermediate cash box according to the preamble of the main claim.

Certain automats which may be actuated with coins, comprise an intermediate cash box (also denoted escrow device), which temporarily stores the inserted coins, which after testing with regard to their authenticity and after determining their value, are accepted by a coin tester. These coins, after they are stored in the intermediate cash box, are either led into the main cash box in the case that the automat has rendered its service, or are returned back if the service may not be rendered.

Various intermediate cash boxes are known in the state of the art, for example DE 20 2004 010 373 U1 discloses an intermediate cash box which comprises a rotation plate which is accommodated in a housing between walls, wherein the rotation plate and the walls comprise a receiver space for the coins. The rotation plate is provided with a toothing at two opposite ends, which engage into longitudinal recesses of the side walls, and a drive is assigned to them, which rotates the rotation plate about a middle axis provided between the toothings, in the clockwise and anticlockwise direction. Depending on the direction in which one rotates, the coins lying on the rotation plate are led into a main cash box or into a return.

The present invention relates an intermediate cash box which has a compact construction and a low electricity consumption, wherein a reliable closure of the receiver space of the coins is ensured.

By way of the fact that the flap arrangement comprises two flaps arranged in a V-shaped manner and a pivotably mounted guide lever with a guide path guiding the movement of the flap is assigned to each flap, and a rotatably mounted movement transmission element driven by a drive transmits the movement of the drive in each case onto one of the two guide levers for its pivoting movement and as a result into the pivoting movement of the flap, it is possible to construct the intermediate cash box in a compact manner, since the space for the pivoting movement only requires the height of one flap. Furthermore, the energy required for the pivoting movement and thus the electricity consumption for the drive is very low, since the weight of the coins supports the opening movement of the flap.

In one advantageous embodiment, the movement transmission element comprises first means for engaging with the respective guide lever for its movement with a result of the opening of the assigned flap, and a second engagement means with a rotation drive acting in two directions.

It is particularly advantageous for a self-locking for each flap to be provided, which is formed by a part of the guide path and a projection which is connected to the flap and which is pressed by the weight of coins possibly present in the receiver space, against a flank of the guide path. The receiver space remains securely closed by way of this, even with the presence of coins, and the automatic locking is only released when the movement transmission element presses onto the guide lever.

The movement transmission element is advantageously designed in a manner such that a triangular shape is spanned between the first means and the second means, wherein the rotation point of the movement transmission element lies within the triangle, for example on a middle line.

In an advantageous manner, the movement transmission element is designed in a Y-shape, with which the rotation point lies in the connection region between the three limbs, and the ends of two limbs in each case press on one guide lever, and the other limb is in active connection with the drive.

Preferably, sensor elements for recognising the position of the movement transmission element are attached on the movement transmission element, and may be scanned by a stationary measurement sensor. Here, the position of the flaps may be detected in a secure manner for the control of the drive. The sensor arrangement may be electro-optical, magnetic, mechanical or of a different nature.

In an advantageous manner, the guide levers, the movement transmission element and the drive are attached to one of the side walls in an outwardly directed manner, whilst the flaps are present between the side walls, by which means the design is simplified.

BRIEF DESCRIPTION OF DRAWINGS

One embodiment example of the invention is represented in the drawing and is explained in more detail in the subsequent description. There are shown in.

DETAILED DESCRIPTION

Figure 1:
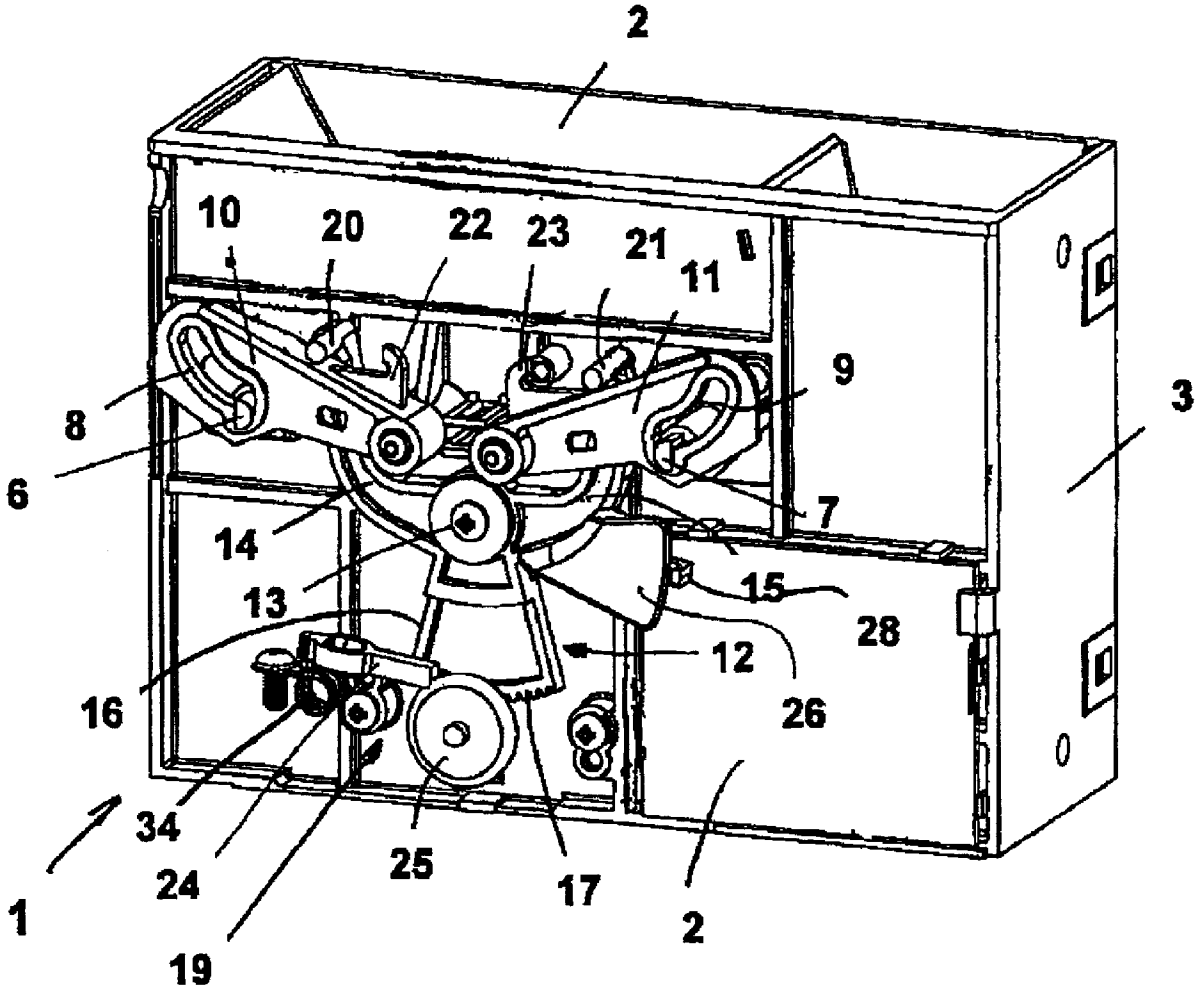
FIG. 1 a perspective view of one embodiment example of the intermediate cash box according to the invention, FIG. 2 essential parts of the intermediate cash box according to the invention, in the idle condition, and FIG. 3 a plan view according to FIG. 1, with an opened flap.
Figure 2:
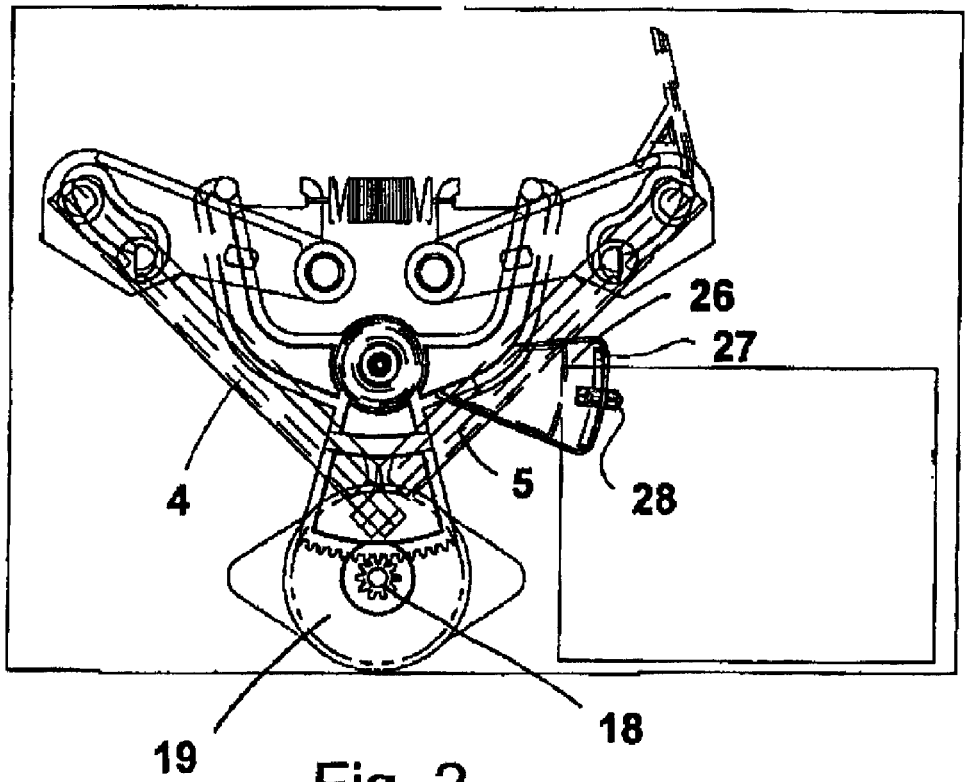
Figure 3:
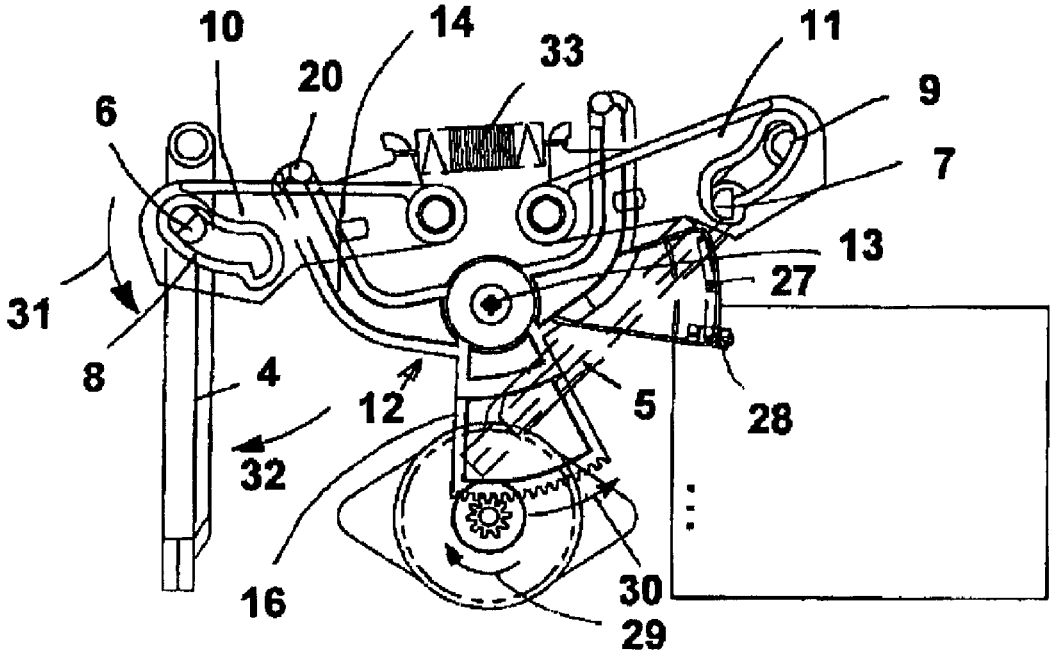

The intermediate cash box represented in FIG. 1 comprises an essentially parallelepiped housing 1 with two side walls 2 and two end walls 3, wherein pivotable flaps 4, 5 are arranged between the two side walls, which may be recognised in FIGS. 2 and 3. The flaps 4, 5 in their idle condition have a V-shape and abut one another with their ends.

The flaps 4, 5 are provided with projections 6, 7 which engage through the side wall 2 and project into the recesses in each case of one guide path 8, 9 which in each case is formed out in a pivotably mounted guide lever 10, 11. The bearing locations for the guide levers 10, 11 are attached on the side wall 2.

A movement transmission element 12 is likewise provided mounted in the side wall 2 and has the shape of a Y, i.e. two arms 14, 15 which proceed from the rotation point 13 and which in FIG. 1 project upwards, and a limb 16 pointing downwards which is essentially trapezoidal and which is provided with a toothing 17 at its side distant to the rotation point 13. The toothing 17 is in connection with a pinion 18 (see FIG. 2, 3) of a drive 19.

The ends of the arms 14, 15 of the movement transmission element 12 are connected to a pin-like projection 20, 21 which may be integrally formed as one piece. The arms 14, 15 lie below the guide levers 10, 11 in the view according to FIG. 1, and the pin-like projections 20, 21 engage over the upper side of the guide levers 10, 11. The levers 10, 11 are provided with lugs 22, 23 which serve for receiving a restoring spring 33 (see FIG. 2, 3).

As may be recognized in the figures, the projections 6, 7 of the flaps 4, 5 which engage into the guide paths 8, 9 have a flattened side, and the slightly curved guide paths 8, 9 are provided with a straight-lined flank, wherein in the idle condition of the flaps 4, 5, the projections 6, 7, which are semicircular in cross section engage, into a correspondingly shaped recess of the guide paths 8, 9, in a manner such that the flattened side of the projections and the straight-lined flanks of the guide paths face one another. These together form a self-locking or self-jamming of the flaps 4, 5, since the two surfaces of the projections and the guide paths are pressed against one another by way of the weight of possibly present coins in the V-shaped receiver space.

The drive 19 in the embodiment example represented in FIG. 1 is designed as a piezoelectric drive with which piezoelectric or piezoceramic elements which are not shown, are arranged in a drive rod 24 and are supplied with an alternating voltage. By way of this, the drive rod 24 is set into vibrational movement, and its front end carries out an elliptical movement. The end is in connection with a drive wheel 25 connected to the pinion, wherein a spiral spring 34 presses the end onto the drive wheel amid biasing, and transits the elliptical movement as a push movement into the one or other direction onto the drive wheel 25, whose pinion, via the toothing 17, transmits the movement to the movement transmission element 12.

One may also apply a stepper motor instead of a piezoelectric drive, on whose drive shaft the pinion 18 is arranged in a fixed manner (see FIGS. 2, 3).

A position transducer element 26 is attached or integrally formed on the movement transmission element, and detects markings 27 which may for example be designed as openings, but also other elements indicating the distance, which are scanned by a measurement sensor 28 e.g. a light barrier, which is fastened on the outer side of the side wall. This signal of the measurement sensor 28 is given to a control unit, which controls the whole course of the movement.

The manner of functioning of the intermediate cash box is described hereinafter in combination with the FIGS. 1 to 3.

If a coin or several coins are inserted into the automats and the associated coin tester, they are tested with regard their authenticity and the value, and if they are accepted, they get into the V-shaped receiver space formed by the flaps 4, 5 of the intermediate cash box. If the products dispensed by the automat, or a service has been made, the coins present in the receiver space must get into the main cash box, to whose supply channel for example the flap 5 must be opened. If however the user of the vending machine does not wish to receive this product or service, then he may actuate a return button, by which means the coin money present in the receiver space is led into a return channel which is released by the flap 4. The user then receives the money which he has inserted, back again.

Depending on which flap is to be opened, in FIG. 3 for example it is the flap 4, the control unit which is not shown, controls the drive 19 which rotates the pinion 18 in the clockwise direction (according to the representation in FIG. 3) according to arrow 29, by which means the trapezoidal limb 16 of the movement transmission element 12 pivots via the toothing 17 according to the arrow 30, and the movement transmission element 12 rotates about the rotation point 13 in the anticlockwise direction. By way of this, the pin-like projection 20 of the arm 14 presses on the guide lever 10, by which means the projection which is semicircular in cross section is moved out of the securing recess of the guide path and may slide freely. The projection 6, guided in the guide path, is displaced by way of a continued pressing of the pin-like projection 20 onto the guide lever 14, by which means the flap is moved downwards. The movement of the guide lever 14 is indicated by the arrow 31, and the movement of the flap by the arrow 32. Thereby, the weight of the coin lying on the flap encourages its downwards movement. The coins may thus fall or slide through the space released by the flap into the return channel.

After the coins are removed, the restoring spring 33 which is tensioned between the lugs and against whose force the drive 19 must work on opening the flap 4, returns back into the initial position with the cooperation of the drive 19, the guide lever 14 and the movement transmission element 12, wherein the projection 6 in the guide path 8 is guided whilst catching the flap, and brought back into its locking condition.

The flap 5 is opened or closed in a corresponding manner.

The ends of the flaps 4, 5 may be designed such that they engage into one another in the closed condition, as is indicated in FIG. 2.

The invention claimed is:

1. An intermediate cash box, comprising:

a housing;

a flap arrangement pivotably mounted in the housing, the flap arrangement forming a receiver space for coins in an idle condition, the coins being released into a path created through a controlled pivoting of the flap arrangement, the path leading to one of a return and a cash box, the flap arrangement including two flaps arranged in a V-shaped manner in the idle condition, each flap including a pivotably mounted guide lever having a guide path, the guide path guiding a movement of the corresponding flap;

a drive; and a rotatably mounted movement transmission element driven by the drive, the element being in an active connection with the guide levers so that a movement of the drive is transmitted onto one of the guide levers for a pivoting movement, wherein the element includes a first engagement arrangement engaging with one of the guide levers for the pivoting movement for a forced opening of the corresponding flap, and wherein the element includes two arms, one of the two arms pressing on the corresponding guide lever to open the respective flap.

2. The intermediate cash box according to claim 1, wherein each of the flaps includes a projection contacting the corresponding guide path, the projection guiding the movement of the corresponding flap.

3. The intermediate cash box according to claim 2, wherein the flaps self-lock through a weight of the coins present in the receiver space pressing the projection against an undercut flank of the guide path for the respective flap.

4. The intermediate cash box according to claim 2, wherein the housing includes two side walls which are distanced by two end-walls, the flaps being arranged between the side and end walls, the guide levers and the element being arranged on an outer surface of one of the side walls with respect to the flaps, the projections of the flaps engaging through the one of the side walls.

5. The intermediate cash box according to claim 1, wherein the element includes a second engagement arrangement which is in connection with the drive, the drive operating two directions, the second arrangement pivoting the element in one of the two directions so that the first arrangement engages one of the guide levers based on the one of the two directions.

6. The intermediate cash box according to claim 5, wherein the element extends a substantially triangular shape between the first and second arrangements, a rotation point of the element disposed within the triangular shape.

7. The intermediate cash box according to claim 5, wherein the second arrangement is a tooth segment which is in connection with a pinion of the drive.

8. The intermediate cash box according to claim 7, wherein the drive is a piezoelectric drive with a drive wheel comprising the pinion.

9. The intennediate cash box according to claim 1, wherein the movement of the guide lever forced by the first arrangement takes place in the path of the coins being released.

10. The intermediate cash box according to claim 1, wherein the element has a substantial Y-shape, a first limb of the Y-shape being in connection with a rotation drive acting in two directions, second and third limbs of the Y-shape forming the two arms, a rotation point of the element being disposed at a connection point of the three limbs.

11. The intermediate cash box according to claim 1, further comprising:

a restoring spring supporting a reverse movement of the flaps, the spring being disposed between the two guide levers.

12. The intermediate cash box according to claim 1, wherein the first arrangement includes a projection substantially shaped like a pin for each guide lever, the projection pressing on the corresponding guide lever for opening the respective flap.

13. The intermediate cash box according to claim 1, further comprising:

position indicator elements recognizing a position of the element and attached on the element; and a stationary measurement sensor scanning the position indicator elements.

14. The intermediate cash box according to claim 1, wherein the drive is a stepper motor with a pinion seated on a drive shaft.

* * * * *